United States Patent [19]

Meindl

[11] Patent Number: 4,802,416

[45] Date of Patent: Feb. 7, 1989

[54] CABLEWAY HAVING A MULTIPASS LIFT CABLE

[75] Inventor: Bernd Meindl, Hard, Austria

[73] Assignee: Konrad Doppelmayr & Sohn Maschinenfabrik Gesellschaft mbH & CO. KG, Wolfurt, Austria

[21] Appl. No.: 56,600

[22] Filed: May 29, 1987

[30] Foreign Application Priority Data

Jun. 3, 1986 [AT] Austria ..... 1489/86

[51] Int. Cl.[4] ..... B61B 7/00; B61B 11/00

[52] U.S. Cl. ..... 104/192; 104/197; 104/173.1

[58] Field of Search ..... 104/173.1, 173.2, 178, 104/189, 192, 196, 197

[56] References Cited

U.S. PATENT DOCUMENTS

| | | | |
|---|---|---|---|
| 2,981,205 | 4/1961 | Bannerman et al. | 104/178 X |
| 3,071,083 | 1/1963 | Hochmuth | 104/178 |
| 4,509,430 | 4/1985 | Creissels | 104/173.1 |
| 4,691,642 | 9/1987 | Creissels | 104/173.1 |

FOREIGN PATENT DOCUMENTS

| | | | |
|---|---|---|---|
| 93680 | 11/1983 | European Pat. Off. | 104/173.1 |
| 114129 | 7/1984 | European Pat. Off. | 104/178 |
| 2605683 | 7/1977 | Fed. Rep. of Germany | 104/192 |
| 2652637 | 5/1978 | Fed. Rep. of Germany | 104/173.1 |
| 667430 | 6/1929 | France | 104/178 |
| 1084185 | 7/1954 | France | 104/196 |
| WO8202524 | 8/1982 | World Int. Prop. O. | 104/196 |
| 149297 | 11/1931 | Switzerland | 104/178 |

*Primary Examiner*—Paul F. Neils

*Attorney, Agent, or Firm*—Herbert Dubno

[57] ABSTRACT

In the cableway having a multistrand lift cable, especially a double strand lift cable, with a plurality of couplable and uncouplable conveying means, the lift cable is guided at a driving station by at least two drive disks coupled with each other. The lift cable is formed by a single closed cable loop which is crossed at least once to form a plurality of cable segments. These cable segments are guided near the regions where the conveying means are coupled and uncoupled and in the conveying path parallel and adjacent each other. At least one crossing point of the lift cable loop is positioned between one of those regions and the cable (guide or drive) station associated therewith, near which the lift cable is fed to or guided from at least two guide disks positioned over each other at different heights by a plurality of deflection rolls. At least two drive disks for the lift cable can be coupled directly with each other for joint rotation but are replaceable by a single drive disk with at least two cable grooves.

9 Claims, 5 Drawing Sheets

CABLEWAY HAVING A MULTIPASS LIFT CABLE

FIELD OF THE INVENTION

My present invention relates to a cableway having a multipass lift cable, particularly a double pass endlessly circulating lift cable.

BACKGROUND OF THE INVENTION

A cableway with a single lift is known which comprises a plurality of endless spliced together conveying rope loops or strands. This conveying rope is guided over a rope disk in a valley station and also in a mountain station.

A plurality of conveying means, i.e. a means for carrying an item or person to or from the valley station from or to the mountain station, such as a simple seat or a gondola, are attached rigidly or are couplable to these rope loops.

In the known apparatus the conveying means have seats for four to eight persons who are sitting and up to ten persons who are standing. The load capacity of the individual conveying means is limited by the diameter of the lift cable and/or by the maximum cross sectional load capacity determined by the diameter of the lift cable.

Since the specification of the diameter of the cable can not be arbitrarily increased and at this time is in the range from 50 mm to 60 mm, the cross sectional load capacity and thus the capacity of the conveying means has an upper limit.

To increase the capacity of the lift rope apparatus in spite of the cable-diameter limits as is described in European Pat. No. 93 680 two parallel endless spliced lift cable loops are provided to which the individual conveying means are jointly coupled. Thus considering the limit to the maximum cross sectional load capacity of one of the conveying cable loops the capacity of this lift rope apparatus or cable way is nearly double that described above.

In this known apparatus both conveying cable loops are driven separately from each other. However since the conveying means are clamped jointly to both conveying rope loops to avoid loads due to swinging of these attached devices it is necessary to move both cable loops with respect to each other simultaneously.

To achieve this simultaneous operation monitoring and control is required. The control means can be mechanical or electrical.

Furthermore both drive systems are couplable with each other for the case of braking or slowing and the simultaneity of motion of both rope loops must also be guaranteed with emergency drives. To feed both rope loops simultaneously for the case of joint operation high construction costs are incurred.

OBJECTS OF THE INVENTION

It is an object of my invention to provide an improved cableway having a multipass lift cable which obviates these drawbacks.

It is also an object of my invention to provide an improved cableway having a multipass lift cable in which the desired simultaneity of operation of several cable segments or strands is attained in a simple way.

It is another object of my invention to provide an improved cableway having a multipass lift cable having a high load bearing capacity but simultaneously a low cost.

SUMMARY OF THE INVENTION

These objects and others which will become more readily apparent hereinafter are attained in accordance with my invention in a cableway having a multipass lift cable, especially a double pass lift cable, with couplable and uncouplable conveying means, in which the lift cable is driven at one of at least two cable stations by at least two drive disks or sheaves coupled with each other.

According to my invention the lift cable is formed by a single closed cable loop which is crossed at least once to form a plurality of loop shaped cable segments. The cable segments guided near the regions where the conveying means are couplable and uncouplable and in the conveying path between those regions are guided parallel and adjacent each other.

At least one crossing point of the single closed cable loop is positioned between one of those regions and one of the cable stations containing a plurality of guide disks or the drive disks associated therewith.

The lift cable is fed to or guided from at least two of the guide or drive disks positioned over each other at different heights by a plurality of deflection rolls.

At least two drive sheaves are coupled directly with each other for joint rotation and are replaceable by a single drive sheave with at least two cable grooves therein. In either case the drive-sheave means can have means forming two cable grooves linked for joint rotation.

Advantageously there are two cable stations, a drive station and a guide station. The drive station can have only one drive sheave with two or more cable grooves for the lift cable, while the guide station can have two or more guide sheaves likewise forming guide-sheave means with two cable grooves linked for joint rotation.

Since only a single closed conveying cable is provided and the drive sheaves are coupled with each other for joint rotation or are replaced by a single drive sheave with a plurality of cable grooves, the required synchronism of the individual segments of the conveying cable is guaranteed in all cases without an expensive control or regulating device.

Since advantageously the lift cable can be guided at least nearly horizontally in the vicinity of the regions in which the conveying means are couplable and uncouplable a known simple construction can be used.

According to another feature of my invention, deflection rolls associated with each other are offset from one another in the motion direction of the lift rope.

Furthermore a plurality of spacing guide rolls are provided between the drive or guide sheaves and the deflection rolls whose rotation axes cross the rotation axes of the above named deflection rolls substantially at right angles.

According to another aspect of the invention, a cableway comprises a lower station provided with at least one guide sheave formed with at least two axially spaced grooves and rotatable about one axis, one of the grooves lying above the other of the grooves, and an upper station provided with at least one guide sheave formed with at least two axially spaced grooves lying one above the other and rotatable about another axis.

A single endless cable is looped between the sheaves in two passes and riding in the two grooves of each sheave so that two parallel closely spaced paired strands are respectively movable upwardly and downwardly between the sheaves over an inclined portion of the cableway lying between the stations.

Means is provided to form a respective coupling zone between each guide sheave and the portion for feeding vehicles onto and removing them from the cable, each vehicle engaging both of the respective closely spaced strands for movement along the portion in a respective direction, the cable having at least one crossover between upper and lower loops between a respective coupling zone and the respective guide sheave.

Means is also provided for driving at least one of the guide sheaves so that the respective grooves are rotated together in shychronous rotation.

Advantageously the means defining each of the zones includes guide means for the strands guiding same substantially horizontally.

The guide means can include deflecting rollers, the deflecting rollers engaging the strands of the paired strands at each zone are offset from one another in the direction of movement of the paired strands.

The the deflecting rollers can have substantially horizontal axes.

Further rollers can engage the paired strands between the deflecting rollers and the respective sheaves and having axes substantially at right angles to those of the deflecting rollers.

The means for driving is preferably located at the upper station, means for tensioning the cable being connected to the guide sheave of the lower station.

BRIEF DESCRIPTION OF THE DRAWING

The above and other objects, features and advantages of my invention will become more readily apparent from the following description, reference being made to the accompanying highly diagrammatic drawing in which.

SPECIFIC DESCRIPTION

Figure 1:
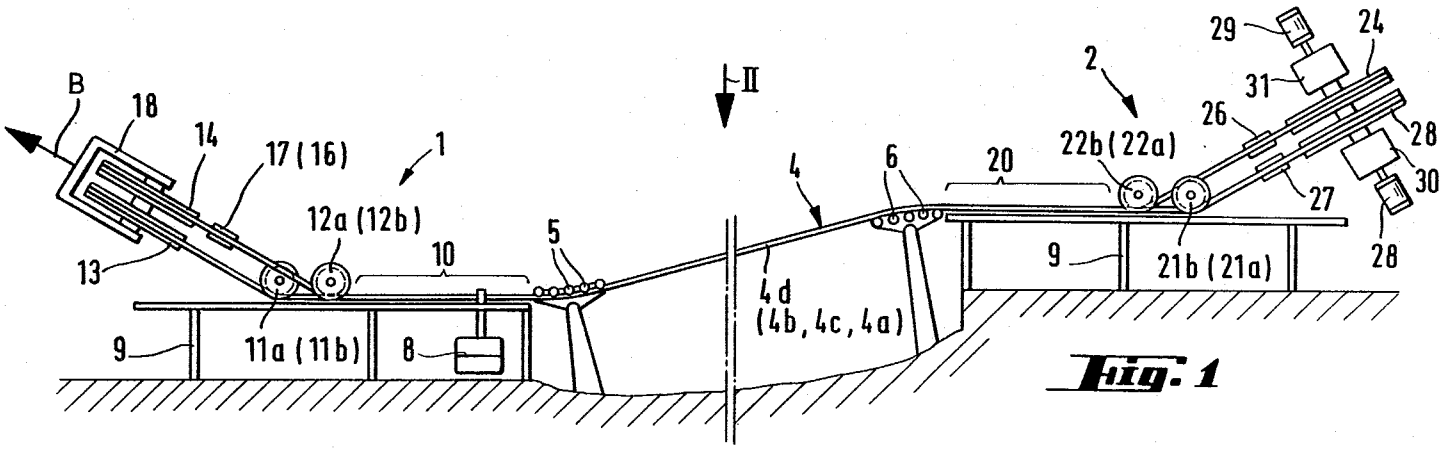
FIG. 1 is a schematic side elevational view of the valley and mountain stations of a cableway according to my invention.

A cableway according to my invention comprises a valley station 1 in which the tension in the lift cable 4 is produced and a mountain station 2 in which the drive unit for the lift cable 4 is located.

The lift cable 4 is guided over a set of deflecting rolls 5 from an approximately horizontal position into an inclined position near the valley station 1. The lift cable 4 is guided from an inclined position by a set of supporting rolls 6 into an approximately horizontal position near the mountain station 2.

Conveying means 8, also referred to as vehicles, such as cabins or simple seats, can be coupled to and suspended from the lift cable 4 at a place or region where the lift cable is approximately horizontal in the valley station 1 and can be uncoupled from the lift cable 4 in the mountain station 2 at a place or region such as zone 20 where the cable is again horizontal.

The lift cable 4 is continuously circulated with a predetermined speed.

When the conveying means 8 is uncoupled from the lift cable 4 passengers can enter or leave it. Then it can be coupled again to the lift cable 4 and moves with that cable.

Although the preceeding is a partial description of the cableway according to my invention and its function, the particulars recited correspond to those known previously.

Figure 2:
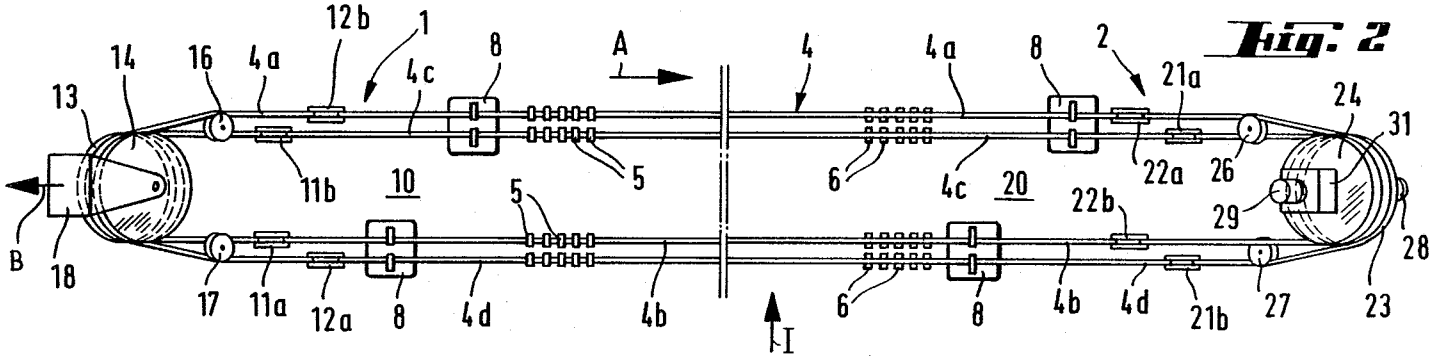
FIG. 2 is a schematic top plan view of a double pass endlessly circulating lift cable according to my invention.

As shown in FIGS. 1 and 2 the lift cable 4 is a double pass cable with four cable segments 4*a*, 4*b*, 4*c* or 4*d* guided substantially parallel to each other and which together form a single closed cable loop. Two pairs of deflecting rolls 11*a*, 11*b* and 12*a*, 12*b* supported on horizontal axes are provided to guide the two pairs of strands into which the cable is divided near the valley station 1.

The guide sheaves 13 and 14 provided in the valley station 1 are located in an inclined position with respect to the horizontal.

Since the pairs of the deflecting rolls 11*a*, 11*b* and 12*a*, 12*b* are offset from one another in the motion direction A of the cable 4, the cable segment 4b running by them is fed to the guide or lower cable sheave 13 by the deflection roll 11*a*. Then it arrives at the deflection roll 11*b*.

Spacing guide rolls 16 and 17 which are pivotally mounted on approximately vertical rotation axes are provided near the valley station 1 to space the rope segments from each other horizontally.

To provide the necessary tension in the lift cable 4 the guide or cable sheaves 13 and 14 are supported on a tension carriage 18 which is guided slidably in the direction of the arrow B by appropriate tensioning means represented by the arrow.

A similar structure including the deflection rolls and the rope sheave is provided in the vicinity of the mountain station 2. In it the cable segments are guided by two pair of deflection rolls 21*a*, 21*b* and 22*a*, 22*b*, which are rotatable about horizontally directed axes and which are offset from each other in the motion direction of the lift cable 4.

Further the cable segments 4*a*, 4*d* are positionable by two spacing guide rolls 26 and 27 which are rotatable about nearly vertical axes. The cable segments 4*a*, 4*b*, 4*c*, 4*d* are guided to drive sheaves 23 and 24 positioned inclined to the horizontal.

The rotation of the drive sheaves 23 and 24 is caused by the associated motors 28 and 29. The rotational coupling between the motors 28 and 29 and the drive sheaves 23, 24 is due to intervening gears and couplings 30,31. The drive sheaves 23 and 24 are coupled with each other for joint rotation and thus their grooves are driven synchronously.

Figure 6:
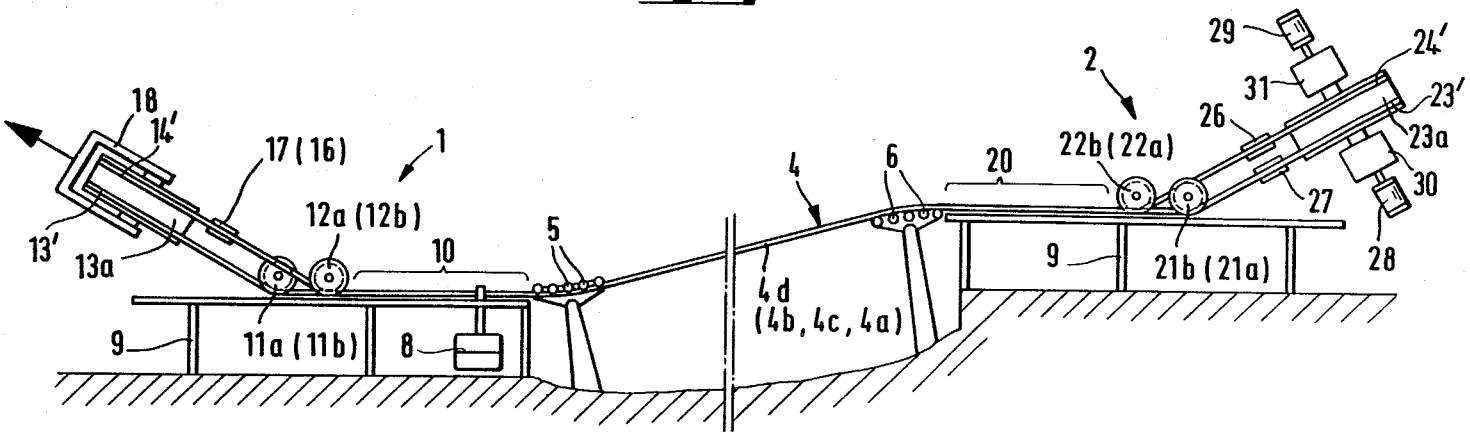
FIG. 6 is a side elevational view of another embodiment of the mountain station of the cableway according to my invention.

Instead of two cable sheaves a single cable sheave with two grooves can be used. Another example of my invention in FIG. 6 shows a side view of a drive station having a single drive sheave 23' with the cable grooves 23*g* in which the lift cable 4 run. Thus synchronization of two separate loops of lift cable 4 is not necessary and operations are further improved.

In my invention the cable segments 4a, 4b and 4c, 4d are formed by a single endless cable loop of lift cable 4 which is guided around the cable sheaves 13, 14, 23 and 24.

The operation of the lift cable 4 is as follows:

The four cable segments 4a to 4d are found at the same height parallel to each other between the deflecting rolls 5 and the supporting rolls 6. In the direction A of FIG. 2 the outer cable segment 4a is fed over the deflection rolls 22a and over the spacing guide roll 26 of the upper drive sheave 24 in the mountain station 2. Then it arrives at the deflection roll 22b.

This cable segment 4b is guided under the deflection roll 11a of the lower guide sheave 13 in the valley station 1. It becomes the rope segment 4c leaving the lower guide sheave 13 guided under the deflection roll 11b.

Near the mountain station 2 the cable segment 4c is fed under the guide roll 21a of the lower drive sheave 23. It arrives at the deflection roll 21b first passing over the spacing guide roll 27.

This rope segment 4d is fed from the deflection roll 12a to the upper guide sheave 14 passing over the spacing guide roll 17 and arrives at the deflection roll 12b first passing over the spacing guide roll 16. Thus the lift cable 4 is a closed endless cable loop.

When only endless closed cable loop is provided and the drive sheaves are coupled with each other in joint rotation the required synchronized course of the cable segments in that portion of the cable in which the conveying means are coupled to them is guaranteed.

The coupling and/or uncoupling of the conveying means occurs in the valley station 1 in region 10 and in region 20 in the mountain station 2. The cable segments 4a, 4b, 4c, 4d are guided nearly horizontally in the regions 10, 20. In these regions which lie outside of the region in which the lift cable 4 is guided over the guide rolls and over the cable sheaves 13, 14 and/or 23, 24 the cable segments also run on a synchronized course although they are no longer parallel to each other. This is possible of course since the conveying means 8 are uncoupled in these regions.

Figure 3:
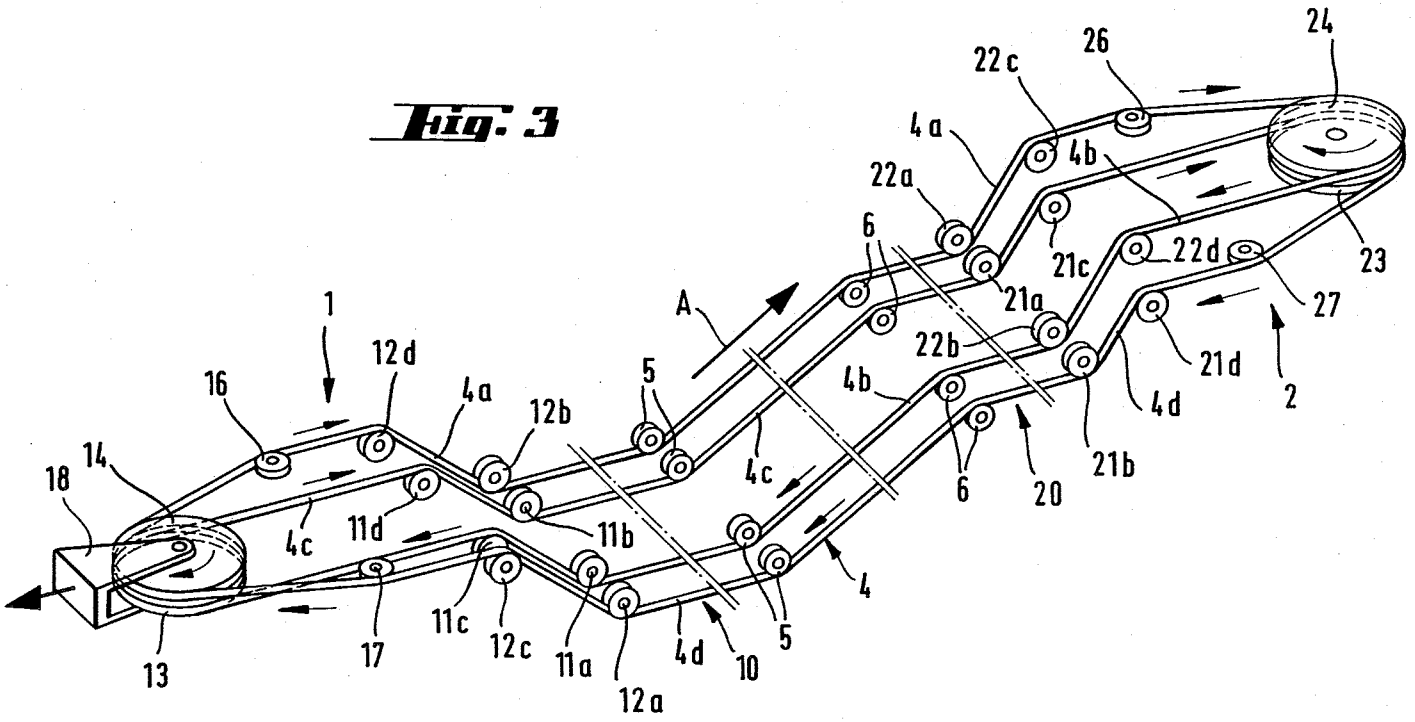
FIG. 3 is an axonometric view of somewhat different cable guide means in contrast to those used in the double pass endlessly circulating cable of FIGS. 1 and 2.

In FIG. 3 is an axonometric view of a somewhat different embodiment than is shown in FIGS. 1 and 2. Thus additional pairs of deflection rolls 11c, 11d and 12c, 12d and/or 21c, 21d and 22c, 22d are provided by which the cable segments are fed to the guide sheaves 13, 14 and/or the drive sheaves 23, 24. The deflections rolls 11a, 12b and 12a, 11b and/or 21a, 21b and 22a, 22b are coaxial.

Figure 4A:
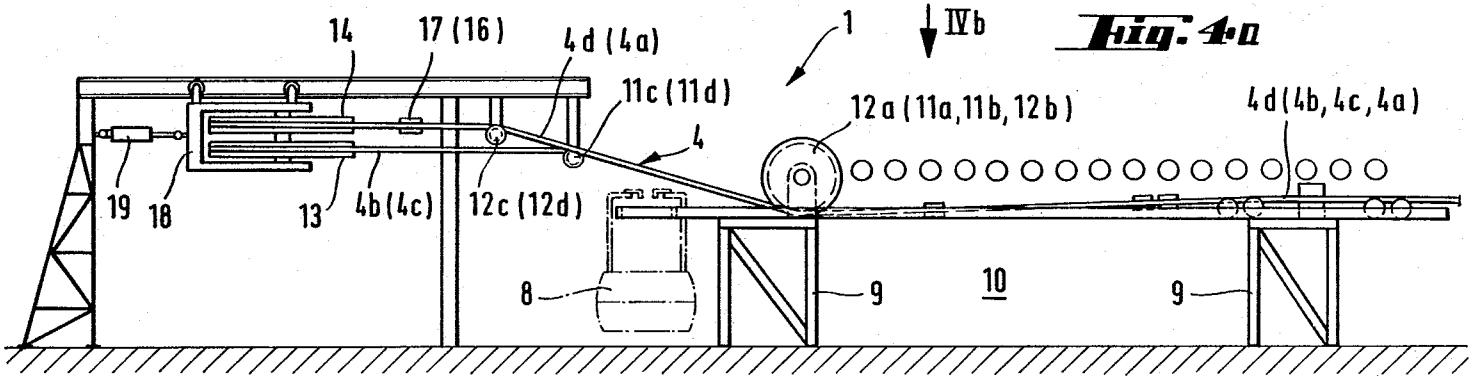
FIGS. 4*a* and 4*b* are side elevational and top plan views of a slightly different embodiment of the valley station of FIG. 1.
Figure 4B:
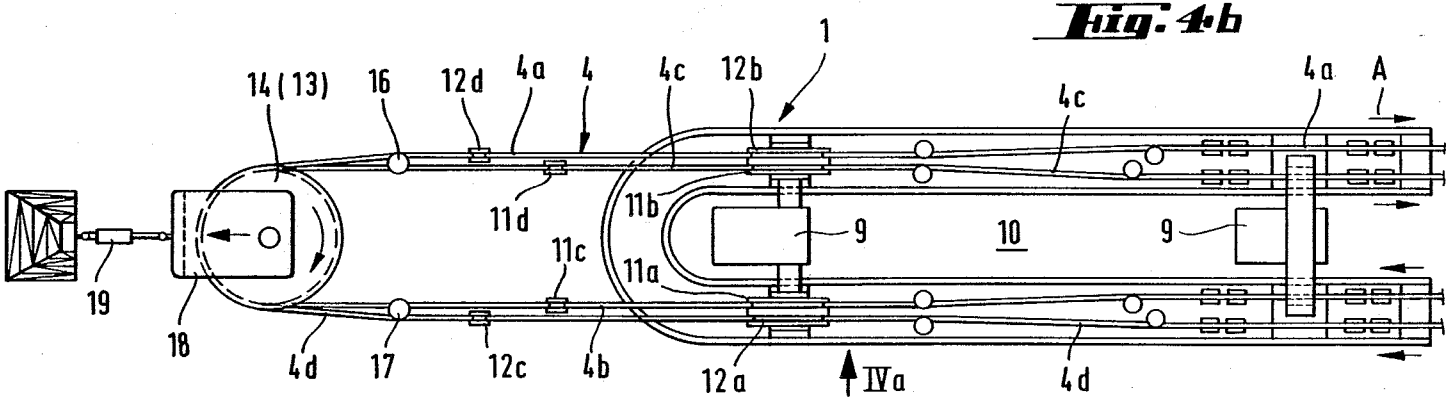
Figure 5A:
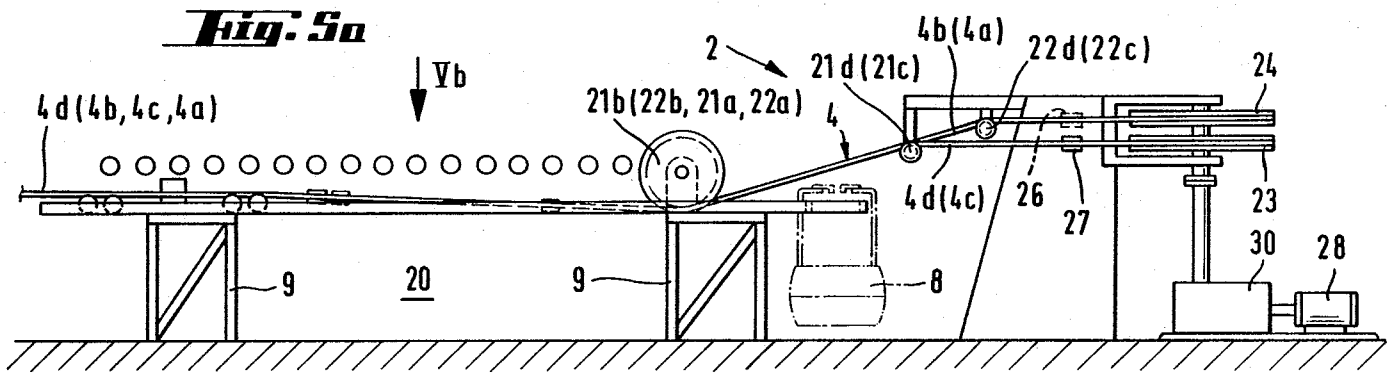
FIG. 5*a* and 5*b* are side elevational and top plan views of a slightly different embodiment of the mountain station of the cableway shown in FIG. 1.
Figure 5B:
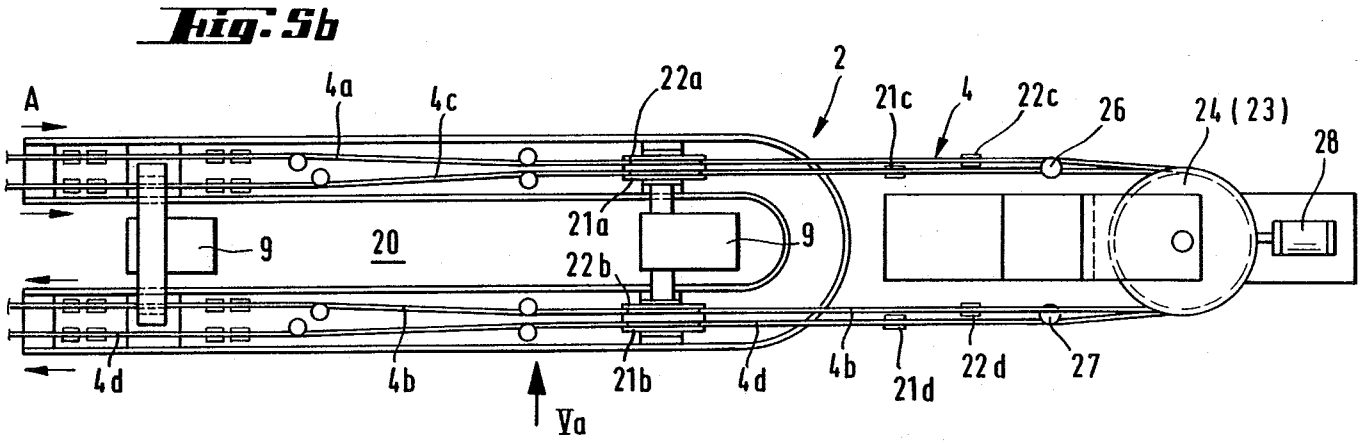

A valley station 1 is illustrated in FIGS. 4a, 4b in which the guide sheaves 13, 14 are found in a horizontal position. The clamping carriage 18 is loaded by a spring 19. A frame 9 provided with guide rails is provided on the valley side of the region 10 in which the conveying means 8 uncoupled from the cable 4 are moved where they can be loaded or unloaded. A mountain station 2 is shown in FIGS. 5a, 5b in which the drive sheaves 23,24 are in a horizontal position.

By cable I mean cable or rope throughout this disclosure.

By cable station I mean either the drive station or the guide station or stations.

In this example the mountain station 2 is the drive station and the valley station 1 is the guide or tensioning station. FIG. 6 shows that the two drive sheaves 13, 14; 23, 24 of FIG. 1 may be replaced by a single drive sheave 13a, 23a, with at least two cable grooves 13', 14'; 23', 24' therein.

I claim:

1. In a cableway having a multipass lift cable, especially a double pass lift cable, with a plurality of couplable and uncouplable conveying means, in which said lift cable is driven at one of at least two cable stations by drive-sheave means having at least two drive sheave grooves coupled with one another for joint rotation, the improvement wherein said lift cable is formed by a single endless cable loop which is crossed at least once to form a plurality of cable segments, said cable segments near the regions where said conveying means are couplable and uncouplable and in the conveying path between said regions are guided parallel and adjacent each other and at least one crossing point of said single closed cable loop is positioned between one of said regions and one of said cable stations containing a guide sheave means with at least two guide-sheave rollers having respective grooves or said drive-sheave means, said lift cable being fed to or guided from at least two of said guide-sheave grooves or said drive-sheave grooves positioned one over the other at different heights by a plurality of deflection rolls, said lift cable being guided at least approximately horizontally in said regions where said conveying means are couplable and uncouplable each of said conveying means being simultaneously suspended from at least two of said segments guided parallel and adjacent to each other.

2. In a cableway having a multipass lift cable, especially a double pass lift cable, with a plurality of couplable and uncouplable conveying means, in which said lift cable is driven at one of at least two cable stations by drive-sheave means having at least two drive sheave grooves coupled with one another for joint rotation, the improvement wherein said lift cable is formed by a single endless cable loop which is crossed at least once to form a plurality of cable segments, said cable segments near the regions where said conveying means are couplable and uncouplable and in the conveying path between said regions are guided parallel and adjacent each other and at least one crossing point of said single closed cable loop is positioned between one of said regions and one of said cable stations containing a guide sheave means with at least two guide-sheave rollers having respective grooves or said drive-sheave means said lift cable being fed to or guided from at least two of said guide-sheave grooves or said drive-sheave grooves positioned one over the other at different heights by a plurality of deflection rolls, said deflection rolls of parallel-moving cable segments in each of said regions being displaced with respect to each other in the motion direction of said lift cable each of said conveying means being simultaneously suspended from at least two of said segments guided parallel and adjacent to each other.

3. The improvement defined in claim 2 wherein between said guide or drive sheaves and said deflection rolls a plurality of spacing guide rolls are provided whose rotation axes are oriented substantially at right angles to the rotation axes of said deflection rolls.

4. A cableway having a multipass lift cable comprising:

a drive station having at least one drive sheave with a plurality of cable grooves for said lift cable;

a guide station having at least one guide sheave for said lift cable;

a plurality of couplable and uncouplable conveying means;

said lift cable is formed by a single endless cable loop which is crossed at least once to form a plurality of cable segments, said cable segments near the regions where said conveying means are couplable and uncouplable and in the conveying path between said regions being guided parallel and adjacent each other and at least one crossing point of said single closed cable loop being positioned between one of said regions and one of said cable stations containing said guide sheaves or said drive sheaves associated therewith, said lift cable being guided from at least two of said guide sheaves positioned over each other at different heights by a plurality of deflection rolls and driven and fed by a single one of said drive sheaves with at least two of said cable grooves therein, said lift cable being guided at least approximately horizontally in said regions where said conveying means are couplable and uncouplable each of said conveying means being simultaneously suspended from at least two of said segments guided parallel and adjacent to each other.

5. A cableway comprising:

a lower station provided with at least one guide sheave formed with at least two axially spaced grooves and rotatable about an axis, one of said grooves lying above the other of said grooves;

an upper station provided with at least one guide sheave formed with at least two axially spaced grooves lying one above the other and rotatable about another axis;

a single endless cable looped between said sheaves in two passes and riding in the two grooves of each sheave so that two parallel closely spaced paired strands are respectively movable upwardly and downwardly between said sheaves over an inclined portion of the cableway lying between said stations;

means forming a respective coupling zone between each guide sheave and said portion for feeding vehicles onto and removing them from said cable, each vehicle engaging both of the respective closely spaced strands for movement along said portion in a respective direction, said cable having at least one crossover between upper and lower loops between a respective coupling zone and the respective guide sheave; and means for driving at least one of said guide sheaves so that the respective grooves are rotated together in synchronous rotation, said means defining each of said zones including guide means for said strands guiding the strands substantially horizontally.

6. A cableway comprising:

a lower station provided with at least one guide sheave formed with at least two axially spaced grooves and rotatable about an axis, one of said grooves lying above the other of said grooves;

an upper station provided with at least one guide sheave formed with at least two axially spaced grooves lying one above the other and rotatable about another axis;

a single endless cable looped between said sheaves in two passes and riding in the two grooves of each sheave so that two parallel closely spaced paired strands are respectively movable upwardly and downwardly between said sheaves over an inclined portion of the cableway lying between said stations;

means forming a respective coupling zone between each guide sheave and said portion for feeding vehicles onto and removing them from said cable, each vehicle engaging both of the respective closely spaced strands for movement along said portion in a respective direction, said cable having at least one crossover between upper and lower loops between a respective coupling zone and the respective guide sheave; and means for driving at least one of said guide sheaves so that the respective grooves are rotated together in synchronous rotation, said means defining each of said zones including guide means for said strands guiding the strands substantially horizontally, said guide means including deflecting rollers, the deflecting rollers engaging the strands of the paired strands at each zone are offset from one another in the direction of movement of the paired strands.

7. The cableway defined in claim 6 wherein said deflecting rollers have substantially horizontal axes.

8. The cableway defined in claim 7, further comprising further rollers engaging said strands of the paired strands between said deflecting rollers and the respective sheaves and having axes substantially at right angles to those of the deflecting rollers.

9. The cableway defined in claim 8 wherein said means for driving is located at said upper station, means for tensioning said cable being connected to said guide sheave of said lower station.

* * * * *